US005464206A

United States Patent [19]

Rodi et al.

[11] Patent Number: 5,464,206

[45] Date of Patent: Nov. 7, 1995

[54] DEVICE FOR CONTROLLING LATERAL SHEET CONTACT AND FOR INTERRUPTING SHEET FEED UPON OCCURRENCE OF FAULTY SHEET CONTACT

[75] Inventors: Anton Rodi, Leimen; Dieter Uhrig, Eberbach; Karlheinz Krestyn, Leimen 3, all of Germany

[73] Assignee: Heidelberger Druckmaschinen AG, Heidelberg, Germany

[21] Appl. No.: 331,007

[22] Filed: Mar. 27, 1989

Related U.S. Application Data

[63] Continuation of Ser. No. 133,207, Dec. 16, 1987, abandoned, which is a continuation of Ser. No. 830,066, Feb. 14, 1986, abandoned, which is a continuation-in-part of Ser. No. 498,241, May 26, 1983, abandoned.

[30] Foreign Application Priority Data

May 26, 1982 [DE] Germany ..... 32 19 653.9

[51] Int. Cl.[6] ..... B65H 7/02

[52] U.S. Cl. ..... 271/227; 271/228; 271/239

[58] Field of Search ..... 277/236, 237, 277/227, 228, 258, 240, 250, 260, 248, 252

[56] References Cited

U.S. PATENT DOCUMENTS

| | | | |
|---|---|---|---|
| 1,951,901 | 3/1934 | Cottrell | 271/228 |
| 2,127,292 | 8/1938 | Gegenheimer | 271/252 |
| 3,227,443 | 1/1966 | Pasquinelli | 271/248 |
| 4,017,066 | 4/1977 | Lasher et al. | 271/239 X |
| 4,058,359 | 11/1977 | Urselmann | 271/228 X |
| 4,060,237 | 11/1977 | Degen et al. | 271/250 |
| 4,310,236 | 1/1982 | Connin | 271/227 |
| 4,410,171 | 10/1983 | Kobayashi | 271/252 |
| 4,478,405 | 10/1984 | Eertink et al. | 271/227 |
| 4,483,530 | 11/1984 | Spencer et al. | 271/227 X |

FOREIGN PATENT DOCUMENTS

| | | | |
|---|---|---|---|
| 732670 | 6/1955 | United Kingdom | 271/266 |

*Primary Examiner*—Matthew C. Graham

*Attorney, Agent, or Firm*—Herbert L. Lerner; Laurence A. Greenberg

[57] ABSTRACT

A feeder for a sheet-fed printing machine having a feeder table having at least one pulling unit coupled to the machine drive train for imparting to each newly arrived sheet a defined direction of pull, and a sensing arrangement for sensing the position of the side edges of the sheet, the feeder which includes at least one sensor having a response range, facing a respective side edge of the sheet, the sensor which produces two distinctly different signals that indicate the presence or absence, respectively, of the sheet in the desired position of the sheet before and after imparting the pull; electronic logic control apparatus operatively responsive to the signals from the sensor that are produced at the first and second interrogation of the sensor before and after the pull for determining if the sheet after the pull is positioned within the response range of the sensor; and alarm indicator operatively responsive to the logic control apparatus for producing an alarm indication in case it is determined by the logic control apparatus, that the respective sheet edge is not present within the response range of the sensor after the second interrogation.

3 Claims, 4 Drawing Sheets

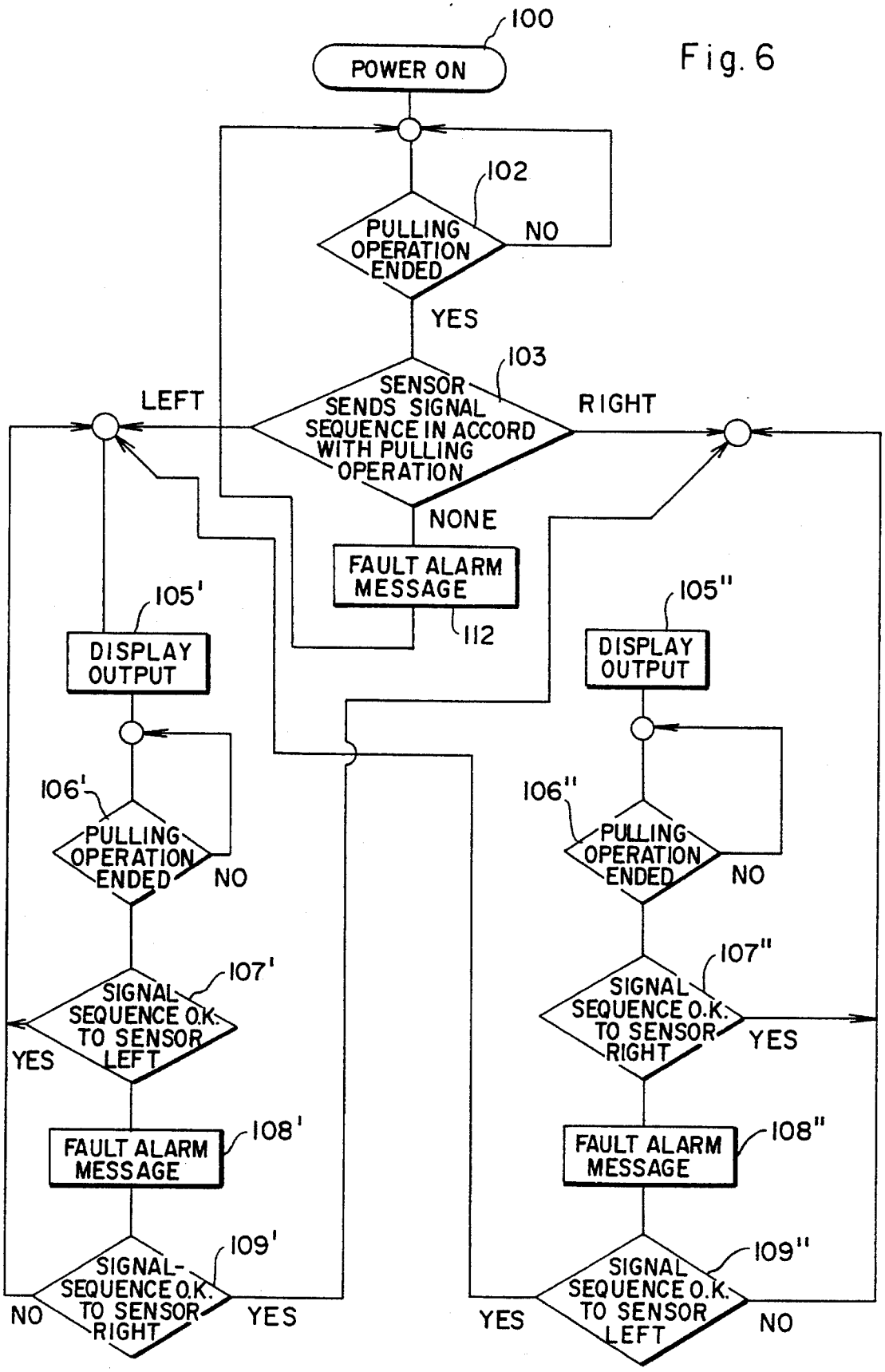
100
POWER ON
Fig. 6
102
PULLING OPERATION ENDED
NO
YES
103
SENSOR SENDS SIGNAL SEQUENCE IN ACCORD WITH PULLING OPERATION
LEFT
RIGHT
NONE
FAULT ALARM MESSAGE
112
105'
DISPLAY OUTPUT
105"
DISPLAY OUTPUT
106'
PULLING OPERATION ENDED
NO
106"
PULLING OPERATION ENDED
NO
107'
SIGNAL SEQUENCE O.K. TO SENSOR LEFT
YES
107"
SIGNAL SEQUENCE O.K. TO SENSOR RIGHT
YES
108'
FAULT ALARM MESSAGE
108"
FAULT ALARM MESSAGE
109'
SIGNAL-SEQUENCE O.K. TO SENSOR RIGHT
NO
YES
109"
SIGNAL SEQUENCE O.K. TO SENSOR LEFT
YES
NO

DEVICE FOR CONTROLLING LATERAL SHEET CONTACT AND FOR INTERRUPTING SHEET FEED UPON OCCURRENCE OF FAULTY SHEET CONTACT

This application is a continuation, of application Ser. No. 133,207, filed Dec. 16, 1987, now abandoned, which is a continuation, of application Ser. No. 830,066, filed Feb. 14, 1986, now abandoned, which is a continuation-in-part of application No. 06/498,241, filed May 26, 1983, now abandoned.

The invention relates to a device for controlling lateral sheet contact and for interrupting sheet feed upon the occurrence of faulty lateral sheet contact and, more particularly, to a combination of a feeder for a sheet-fed rotary printing machine having pull markers coupled to the machine drive for imparting a pulling movement to every arriving sheet, together with a device for controlling correct lateral sheet position and for interrupting sheet feed upon the occurrence of faulty lateral sheet position.

Heretofore known constructions of feeders are individual sheet feeders and fish-scale type or overlapping feeders. Orientation or alignment of a sheet, which is required for registered printing, occurs, during the transport of the sheet over the feeder table, in two directions, namely the forward transverse direction and in the lateral direction. The more forward markers there are provided, the greater the assurance of a reliable position of the leading edge of a sheet. The lateral alignment is effected mostly by means of pulling markers.

Pulling markers in sheet-fed printing machines have the function of exactly orienting the sheet arriving from the feeder by means of lateral pulling. This adjusting must be accomplished with the greatest precision, because color differences can occur between the printed sheet copies due to faults or errors in straightening or alignment.

Sheet-fed printing machines with pulling markers have become known from German Published Non-Prosecuted Application (DE-OS) 30 11 626 A1. The sheet to be aligned is pressed with the aid of a tickler roller against suction openings in a valve plate. The vacuum supporting the pulling operation can take place in a manner defined with respect to time so that the high static friction during sheet standstill is overcome and, by switching off the suction air, crumbling of the sheet at a stop is avoided.

Devices have additionally become known heretofore for registered or precisely fitted contact of the sheet to be printed, from German Published Non-Prosecuted Application (DE-OS) 24 60 747. A device is described therein which achieves the desired contact accuracy or exactness without using any pulling markers. A measuring head with two photosensors is laterally attached in the feeder plate, and the side difference which is determined serves as directional quantities or values for lateral shifting of the gripper drum or cylinder. In any event the lateral shifting of the gripping drum is mechanically and technically difficult and also does not always lead to a precisely registered position. In addition, the use of two photosensors is very costly.

It is accordingly an object of the invention to provide a device which, with the simplest means, monitors both the correct final pulling operation as well as the pulling operation per se, and shortens the preparation times and down times of sheet-fed rotary printing machines.

With the foregoing and other objects in view, there is provided, in accordance with the invention, in combination, a feeder for a sheet-fed rotary printing machine having pull markers coupled to the machine drive and imparting a pulling movement to every arriving sheet, and a device for controlling correct lateral sheet position and for interrupting sheet feed upon occurrence of faulty lateral sheet position, comprising a sensor located at least at one lateral edge of the feeder for controlling correct sheet arrival and lateral position of the sheet, and a digital electronic control system operatively connected to the sensor and to the controlling device for receiving signals from the sensor, processing the signals and, in accordance with the signals, exerting an influence upon the controlling device.

It is thereby an advantage, that the operator of the sheet-fed rotary printing machine can see immediately what type of fault or error exists due to the display in a light-emitting diode display field and can accordingly readily take care of the fault.

In accordance with another feature of the invention, the sensor is constructed so that, before the pulling movement, the arriving sheet is initially beyond response range of the sensor and, at end of the pulling movement, is within the response range, the electronic control system having means for producing a corresponding message.

In accordance with an additional feature of the invention, the electronic control system has means for producing a message whenever a sheet is first outside the response range of the sensor before the pulling movement and is then located inside the response range after the pulling movement.

In accordance with another feature of the invention, an error message is produced if the sheet is still outside the response range of the sensor after the end of the pulling operation.

In accordance with a further feature of the invention, there is provided a plurality of sensors, and the electronic control system, upon receiving a signal sequence delivered by the sensors, in the response range of which the sheet, after being pulled, assumes either one of the desired positions, respectively, and wherein the control system recognizes an assignment from one of the sensors to direct the movement of the respective pull marker, and then issues a message as a result of signal sequences delivered by the one sensor.

In accordance with again another feature of the invention, the sensor is either a reflex detector, a light barrier or a reflex light barrier.

In accordance with again an additional feature of the invention the sensor is either a capacitive or a pneumatic detecting element.

In accordance with a further feature of the invention, there is provided a light-emitting diode display field having LEDs for reproducing respective relevant operating conditions and fault indications, the light-emitting diode display field being coupled with the electronic control system.

Due to the indication of the corresponding light-emitting diodes, a fault may be recognized relatively easily and rapidly, which has a positive effect upon the undesirable down times of sheet-fed rotary printing machines.

In accordance with still a further feature of the invention, there is provided an intermediate memory and a programmable read-only memory EPROM, and the digital electronic control system is connected to the immediate memory and the EPROM, and is constructed so as to transmit signals from the sensors in regard to the desired position of the sheet via the intermediate memory and the EPROM to a display in the LED display field, so that, in case of power failure, the position data are not lost.

In accordance with again another feature of the invention, the electronic control system is constructed so as to produce an alarm when the position of the sheet is faulty.

In accordance with still another feature of the invention, the alarm is either optical or acoustic.

In accordance with still a further feature of the invention, the electronic control system is constructed so as to affect control of the printing machine when the position of the sheet is faulty.

In accordance with a concomitant feature of the invention, there is provided two sensors, and the sensors have a construction independent of the pulling direction and are equally suited for either pulling direction both with respect to function and construction thereof. The device according to the invention thus permits an improved monitoring and straightening or orientation of the sheet feed. The automatic recognition of the pull direction produces, with the aid of the sensors, a change in the pull direction without additional operating expense. Without such an automatic pull-direction change, a switch-over of the control or removal of an unused sensor from the operating area of the feeder table or modification of the sensor on the other side would otherwise be necessary.

Other features which are considered as characteristic for the invention are set forth in the appended claims.

Although the invention is illustrated and described herein as embodied in a device for controlling lateral sheet position and for interrupting sheet feed upon occurrence of faulty lateral sheet contact, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a diagrammatic view of a slot initiator in a position a;

FIG. 6 is a flow diagram showing the operation of the device according to the invention;

Figure 1:
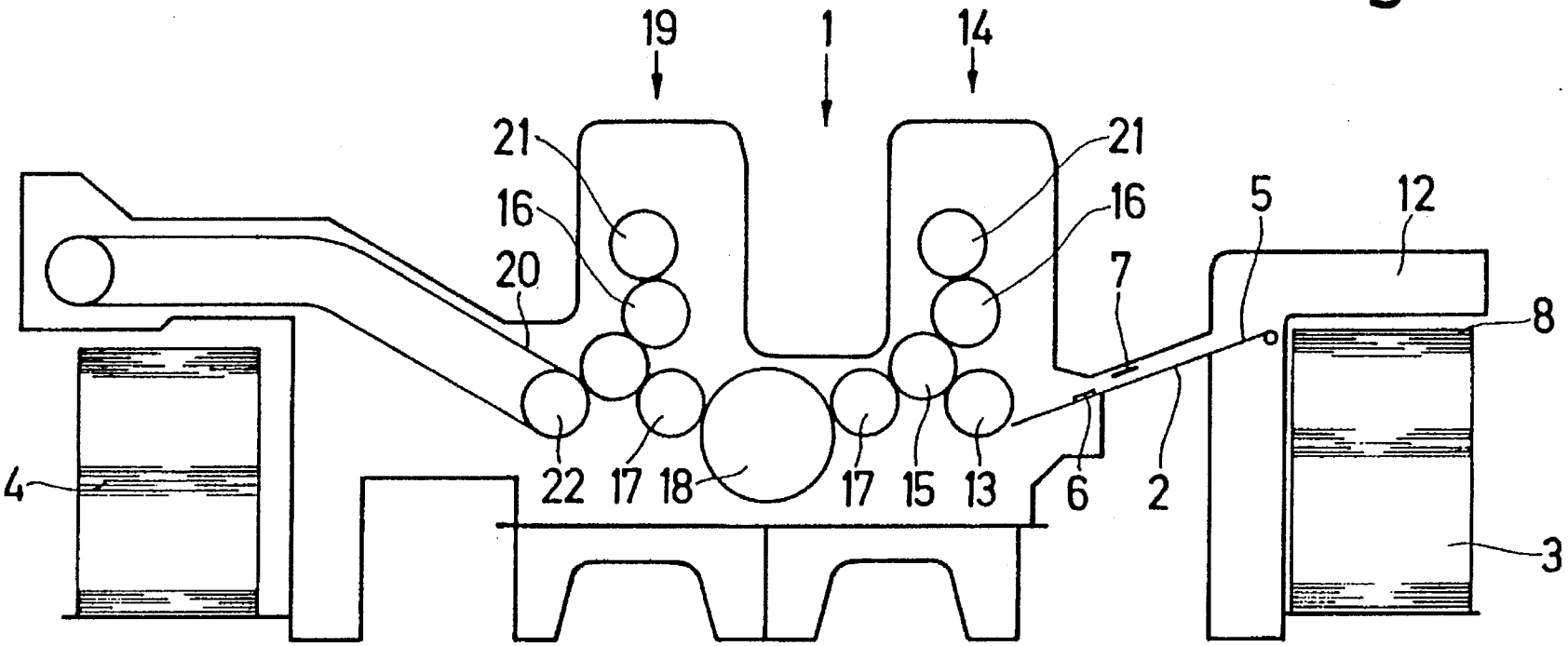
FIG. 1 is a side elevational diagrammatic view of a sheet-fed rotary printing machine with feed and delivery tables.

Referring now to the drawing and, first, particularly to FIG. 1 thereof, there is shown a sheet-fed rotary printing machine 1 in tandem type of construction wherein a sheet 8 to be printed is fed from a sheet feeder 12 over a feed table 2 to a feed cylinder 13 of a first printing unit 14. The printing unit 14 encompasses a plate cylinder 21, a blanket cylinder 16 and a pressure cylinder 15. After each sheet 8 is provided with a first printing, transfer thereof is effected via transport cylinders 17 and a reversing drum 18 disposed therebetween, and a further printing unit 19. The printing unit 19 includes, in turn, a plate cylinder 21, a blanket cylinder 16 and an impression or counterpressure cylinder 22. After the sheet 8 has been provided with a further printing in the printing unit 19, deposition of the sheet upon a delivery stack 4 is effected through the intermediary and aid of a chain-driven sheet delivery system 20.

The invention, briefly described in reference to the figures is directed to indicate to a sheet-fed printing machine operator (printer) if a sheet 8 is properly oriented when it is placed on the feeder table 2 by the mechanical sheet feeder 12. A two-step interrogation is made of the sensor 7 which is used to control the sideway (lateral) positioning of the sheet. A slot initiator 23 with a rotating disc 11, which rotates in synchronism, with the machine's drive train having an electrical switch 10, operates to interrogate the sensor 7 and thereby the position of sheet 8 at two points in the machine cycle, namely at interrogation times t1 and t2, corresponding positions a and b.

Figure 2:
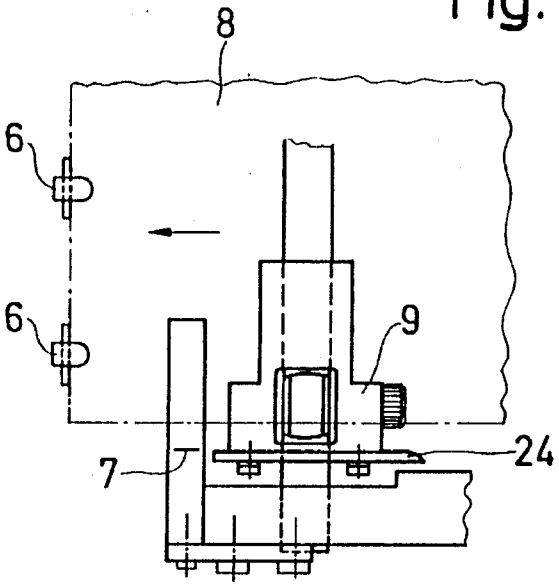
FIG. 2 is an enlarged fragmentary top plan view of the feeder table of FIG. 1 showing the feed table with a corner of a sheet disposed thereon before it has been pulled and a device for controlling the pull markers.
Figure 3:
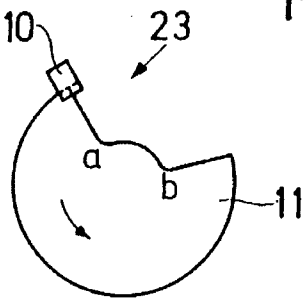

The position of the sheet 8 and the slot initiator 23, at time t1, is shown in FIGS. 2 and 3, wherein the left hand forward corner of a sheet 8 is indicated by a stippled line. At this time, t1, the sheet's leading edge is aligned with two forward stops (front markers) 6, but the left hand edge is not yet aligned with the side stop (inside marker) 24. At this time t1 the sensor 7 is interrogated by the switch 10 of the slot initiator 23, which indicates that the sheet 8 is not within the response range of the sensor. Under control of a control circuit described in more detail hereinbelow, a pull marker 9 which has a friction wheel and motor (not shown) which is capable of pulling the sheet 8 sideways toward the sidestop 24 and the sensor 7, is started.

Figure 4:
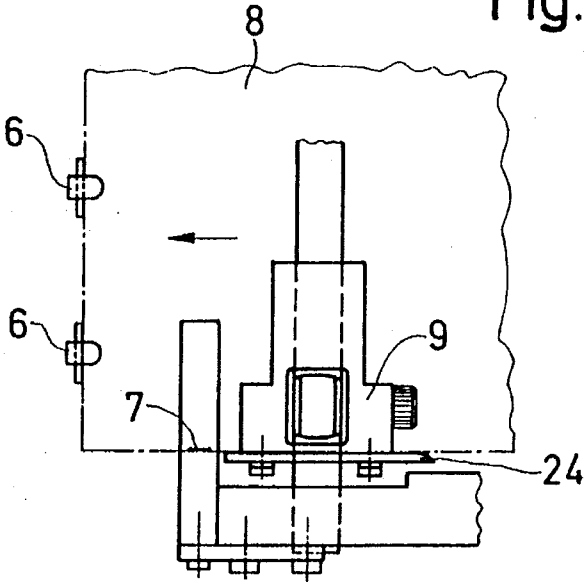
FIG. 4 is another view like that of FIG. 2, however, after the sheet has been pulled.

It should be noted that many different types of sensors 7 are available and known. The invention is not directed to the type of sensor used, but one type, the so-called reflex sensor is well suited. The reflex sensor has a light and a photocell placed in a recess in the feeder table, and when a sheet is within the response range, light reflected from the sheet activates the photocell. The photocell is connected to a control circuit that activates the pull marker 9 to pull the sheet 8 to the left hand side, until the sheet edge abuts the side marker 24. In this position, the paper's edge is within the response range of the sensor 7, as shown in FIG. 4. The paper's sideway movement is stopped by the side marker 24, and at time t2, when the interrogator disc 11 is in position b, as shown in FIG. 5, the sensor 7 is again interrogated to test if the paper is actually positioned with its left hand edge aligned with the sensor 7.

If the test shows that the sheet edge is present within the range of the sensor 7, the sheet 8 is properly located.

The interrogator switch 10 has a transfer contact capable of engaging one of two contacts, depending upon the position of the interrogator disc 11. The transfer contact is connected to a switch contact located in the sheet feeder 12 coupled to the machine drive train, which is not shown. The switch contact closes during the machine cycle, whenever a sheet has been placed on the feeder table 12, but has not been finally positioned on the table.

At time t1, the transfer contact coupled to the interrogator disc 11 by a cam, engages contact of switch 10, and connects ground potential to the pull marker 9, controlled by the sensor 7, which starts the pull marker 9 which in turn pulls the sheet 8 toward the side marker 24 driven by a plus potential also connected to the pull marker 9. When the interrogator disc 11 comes to position b at time t3, ground potential from switch is again transferred to contact a of switch 10. The pull marker 9 is stopped, if it has not already been stopped by the sensor 7.

The memory 30 of the memories 29, 30, may be a so-called EPROM, which is capable of retaining the fact that a fault condition was encountered, in case power failure should occur at the time a feeding failure was detected. By that means the machine operator is alerted to the fact that a sheet may be in a faulty position, and a new machine cycle is not initiated until the fault condition is corrected.

Figure 7:
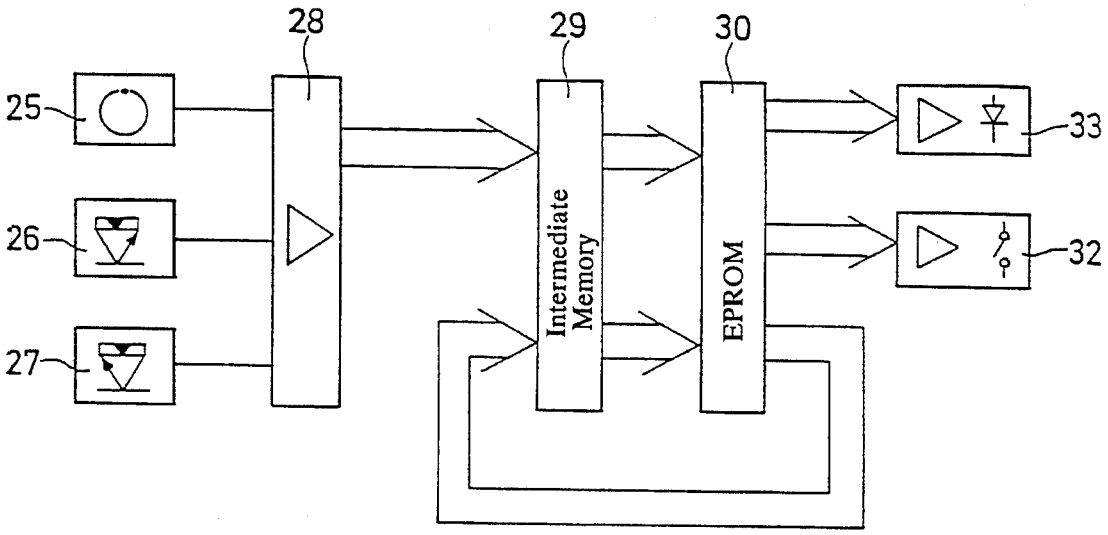
FIG. 7 is a block circuit diagram of the electronic control of the device according to one embodiment of the invention.

In a further embodiment of the invention, two sensors 26 and 27 are provided, one at each side of the feeder table end, a more complex control circuit, as indicated in FIG. 7 may be provided.

In this case, the position of a new sheet can be tested by the sensors 26 and 27, and a side selector switch may be provided, which under control of the operator, decides if the sheet is to be pulled toward the left hand or the right hand side, based on the logic signals, 0 or 1 produced by the switch or the respective sensor 26 and 27, and the slot initiator 23, and which are processed in the electronic control circuit shown in FIG. 7. In this case, the printer can simply switch the sheet feeder 12 to operate the feeder so that a left hand side marker 24 or a right hand marker 24 is to be used.

In still another embodiment, there are four sensors provided in the feeder table, of which two sensors 7 are disposed in alignment with the left and right hand side markers 24, respectively as described hereinabove and two other inside sensors 26 and 26 are disposed within the perimeter of the feeder table, such that each new sheet placed on the feeder table engages one of the inside sensors, which in turn determines if the sheet is to be pulled to the right or to the left hand side of the feeder table.

The control program stored in the control memory includes all the instructions required to operate the electronic control, in accordance with the instant disclosure as shown in a flow-chart seen in FIG. 6. The flow chart shows, step by step, the operation of the control circuit.

Referring now to FIG. 6, in step 100, power is switched on, and a sheet is placed on the feeder table 2 by the sheet feeder 12. The slot initiator 23 arrives at time t1 at position a in step 102. In step 103 a test is made to test which side marker is to be used as determined by sensors 26, 27 or by the side select switch. If the left hand side marker is selected, the program proceeds through steps 103 Left, 105'–108' and 109', while, if the right hand side marker 24 is selected, the program proceeds through the steps indicated by double prime reference numerals. Assuming, the left hand side marker is selected in step 103, step 105' tests if the left hand sensor 26 is on. If affirmative, the step 107 indicates proper sheet location at light indicator 39. If the test in step 107' is negative, the left hand pull marker 9 is started and pulls the sheet 8 to the left. At time t2 when the slot initiator 23 is in position b, in step 107', a test is again made in step 109 to see if the left hand sensor 26 is on. If affirmative, the sheet "OK" indicator 39 is lighted and the machine feeder cycle continues. Returning now to step 103, if the right hand side marker were indicated, the control will continue to operate through steps 105"–109" if the sheet position is proper, or if it is faulty, as described for the left hand side.

Instead of stopping the machine in step 112, a switch may be provided that allows the printer to continue sheet feeding, even in case of a minor or a single isolated feed failure, in which case steps 109' and 109" would lead to step 105" and 105', respectively, to continue.

The sensors 7 or 26, 27 are all be of identical construction and are advantageously of the type known as reflex sensors, as described hereinabove.

Figure 5:
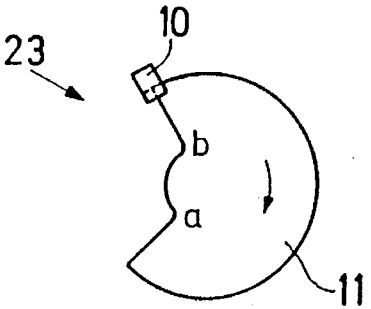
FIG. 5 is a view similar to that of FIG. 3, however, with the slot initiator, in a position b.

In other words in a forward area of the feed table 2, sheet control elements, for example, in the form of reflex sensors or feelers 7, are provided. The slot initiator 23 which includes an interrogator switch 10 and a rotating interrogator disc 11 is coupled, via an electronic control system, with the sheet control elements constructed as reflex sensors 7 and 26, 27. The interrogator disc 11 of the slot initiator 23 is mounted on an otherwise non-illustrated single-revolution shaft. The interrogator disc 11 which is controlled by the timing clock of the printing machine can assume two interrogator timing positions namely a or b. The interrogator disc 11 of the slot initiator 23 represented in FIG. 3 is initially located in the interrogation position a. This means that the sheet 8 initially strikes against the front markers 6, as shown in FIG. 2; the sheet 8, however, has not yet been pulled by the pull marker 9 to the side marker 24. As a condition of the course of operation of the printing machine, the sheet 8 is then pulled sideways by the pull marker 9, e.g. toward the left hand side and toward the side marker 24. Simultaneously, the interrogation disc 11 of the slot initiator 23 moves toward interrogation position b, as shown in FIG. 5. After the pulling operation, the sheet 8 is located width its left hand edge within the response range of the reflex sensor 7 abutting against the side marker 24, as illustrated in FIG. 4.

The course of the pull marker control is shown by the flow diagram presented in FIG. 6.

When the electric power line is switched on and the sheet-fed rotary printing machine 1 is in operation, the electronic control system recognizes, in response to the position of the slot initiator 23 and the signal sequence from the sensors 27 and 26" whether or not the pulling operation should have ended. In accordance with the signal sequence stored in the electric control system, the latter decides automatically the direction of pull whether to the "right" or to the "left".

If no clear signal sequence is delivered by the sensors, an alarm message follows, and the interrogation is repeated.

After the electronic control system has recognized, due to the delivered signal sequence, that there has been a pull, for example, to the left-hand side, this is represented in the luminescent or light-emitting diode display field 33 (FIG. 8) which has been mounted so as to be readily visible by the printer on a sheet metal panel located between the sheet feeder 12 and the printing unit 14 of the sheet-fed rotary printing machine.

Every pulling operation is monitored in this manner.

If no signal sequence occurs in accordance with the pulling operation towards, for example, the left-hand side after a pulling operation has ended, the electronic control system issues an alarm message which is indicated in the light-emitting diode display field 33.

Simultaneously, the electronic control system monitors whether or not, due to the anticipated signal sequence at the reflex sensors 27, 26 if the actual pulling direction of the sheet has changed. If no change has occurred, a pulling error or fault clearly exists which is likewise indicated on the light-emitting diode display field 33.

If a pulling direction change to the left has been recognized due to the signal sequence, the electronic control system automatically monitors also the pulling operation to the right hand side, and a new indication occurs in the light-emitting diode display field 33 if a pull to the right is detected. The interrogation point in time, and the details of the respective operating conditions and the automatic decision as to the pulling direction, towards the right-hand side or towards the left-hand side, is repeated for each new arriving sheet and are similar.

In the block circuit diagram of the pulling marker control system, represented in FIG. 7, there are shown a machine timing clock 25 which runs synchronously with the slot initiator 23, by which the time duration for establishing the actual position values are controlled by means of a comparator device and transmission of the signals to the light-emitting diode 33, and, furthermore, by reflex sensors 27 and 26 which are connected via amplifiers 28 to inputs of the intermediate memory 29, the inputs and outputs of which are symbolically combined and shown as single busses; the outputs of the intermediate memory 29 lead to the inputs of a programmable read-only memory EPROM 30, the outputs of which, in part, are fed to the LED-display field 33 and to an acoustic fault indicator 58.

The electronic control system is so arranged that it interrogates the condition of the reflex sensors 27 and 26" twice during a machine cycle 25. The first interrogation instant is before the pulling operation. The condition of the reflex sensors 26, 27 is transmitted via the amplifier 28 to the processor 51 and the intermediate memory 29 which conducts this information to the EPROM 30, which is a programmable read-only memory (EPROM). The EPROM 30 is programmed so that it awaits the condition message of the second interrogation which contains therein information as to whether or not the sheet has reached the proper desired location after the pulling operation.

If the EPROM 30 has stored all information necessary for a machine cycle 25, it transmits, in accordance with the programming of the EPROM 30, digital values to the LED display field 33, which further transmits the signal sequence of the respective operating condition, or to an acoustic fault indicator formed of acoustic signal transmitters.

These interrogation instants and details or data of the respective operating conditions are repeated for each arriving sheet.

Figure 8:
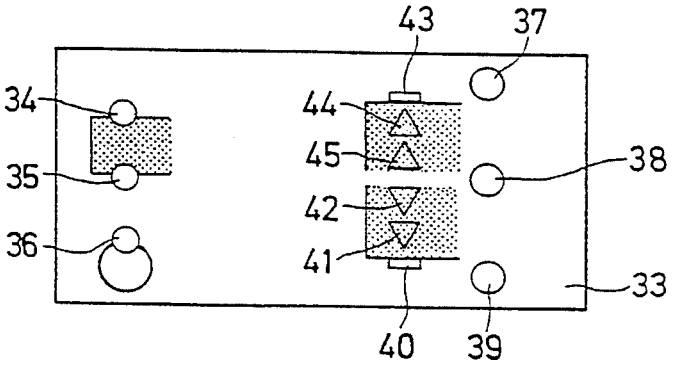
FIG. 8 is a diagrammatic view of a light-emitting diode display field forming part of the device according to the invention.

The LED display field 33 in FIG. 8 is formed of display or indicator elements 34 to 45 which light up according to the respective operating conditions. In particular, the display elements 34 to 45 are formed in three columns, and the three LEDs 34, 35 and 36 are disposed in one column. The LEDs 34 and 35 are yellow colored lighting display elements for the reflex light sensors 26, 27 at the right-hand or the left-hand side, respectively. The yellow LED 36 indicates the condition of the slot initiator 23. In the next row, the respective pulling operations are displayed by the informing symbolic light fields 40, 41, 42, 43, 44 and 45. The yellow symbolic light fields 40 and 43 correspond to the lateral position. If lateral positioning occurs correctly, the symbolic light fields 44 and 41, respectively, light up green for the right-hand and the left-hand sides respectively. When the side position is faulty, the symbolic light fields 42 and 45 signal the fault or error in red. The green LEDs 37 and 39 indicate if the sheet has come into correct side position and the LED 38 signals a faulty side position.

We claim:

1. Feeder for a sheet-fed printing machine having a feeder table having at least one pulling unit coupled to the machine drive train for imparting to each newly arrived: sheet a defined direction of pull, and a sensing arrangement for sensing the position of the side edges of the sheet, the feeder which comprises:

at least one side stop attached to the side of the feeder table, facing the sheet;

at least one sensor having a response range, facing a respective side edge of the sheet, the sensor which produces two distinctly different signals that indicate the presence or absence, respectively, of the sheet in the desired position of the sheet before and alter imparting the pull;

two-step interrogation means synchronously driven by the machine drive train for performing a first and a second interrogation of said sensor respectively before and after the pull;

electronic logic control apparatus operatively responsive to the signals from said sensor that are produced at said first and second interrogation of said sensor before and after the pull for determining if the sheet after the pull is positioned within the response range of the sensor;

alarm indicator having means for responding to the logic control apparatus for producing an alarm indication, indicating in case it is determined by the logic control apparatus, that the respective sheet edge is not present within the response range of the sensor and its position after the second interrogation;

means responsive to said logic control apparatus for interrupting sheet feed in case of said alarm indication; and side selection means for determining the direction of pull at the time of the first interrogation; and wherein the control logic is responsive to the sequence of said signals produced before and after the pull to determine the actual direction of pull imparted to the sheet and to produce an alarm indication for indicating the absence of desired direction of pull.

2. Feeder table according to claim 1, wherein said side selection means further include a side select switch for manually selecting the direction of pull.

3. Feeder for a sheet-fed printing machine having a feeder table having at least one pulling unit coupled to the machine drive train for imparting to each newly arrived sheet a defined direction of pull, and a sensing arrangement for sensing the position of the side edges of the sheet, the feeder which comprises:

at least one side stop attached to the side of the feeder table, facing the sheet;

at least one sensor having a response range, facing a respective side edge of the sheet, the sensor which produces two distinctly different signals that indicate the presence or absence, respectively, of the sheet in the desired position of the sheet before and after imparting the pull;

two-step interrogation means synchronously driven by the machine drive train for performing a first and a second interrogation of said sensor respectively before and after the pull;

electronic logic control apparatus operatively responsive to the signals from said sensor that are produced at said first and second interrogation of said sensor before and after the pull for determining if the sheet after the pull is positioned within the response range of the sensor;

alarm indicator having means for responding to the logic control apparatus for producing an alarm indication, indicating in case it is determined by the logic control apparatus, that the respective sheet edge is not present within the response range of the sensor and its position after the second interrogation;

means responsive to said logic control apparatus for interrupting sheets feed in case of said alarm indication;

an interface amplifier having inputs connected to said sensors and said clock;

a control processor having a memory for storing control programs;

an intermediate memory connected via the intermediary of said interface amplifier to said sensor for temporarily storing the signals from the sensor;

an erasable programmable ROM connected to said intermediate memory for storing the signals stored in the intermediate memory during power failure; and a connection from said erasable programmable ROM to said alarm indicator for producing a visual or acoustic fault indication of the last state of said sensors that existed immediately prior to a power failure.

* * * * *